United States Patent [19]

Krug et al.

[11] Patent Number: 4,563,117

[45] Date of Patent: Jan. 7, 1986

[54] TRAILER HITCH RETAINER PIN RETENTION APPARATUS

[75] Inventors: John A. Krug, St. Charles; Angelo J. Buffone, St. Louis, both of Mo.

[73] Assignee: ACF Industries, Incorporated, Earth City, Mo.

[21] Appl. No.: 617,101

[22] Filed: Jun. 4, 1984

[51] Int. Cl.[4] ..... A47B 97/00

[52] U.S. Cl. ..... 410/56; 248/503; 410/48

[58] Field of Search ..... 410/56, 48, 64, 60, 410/61, 62, 63; 248/502, 503, 500

[56] References Cited

U.S. PATENT DOCUMENTS 3,084,803 4/1963 Bayers ..... 410/48

3,143,978 8/1964 Clejan ..... 410/64

*Primary Examiner*—Henry Bennett

*Attorney, Agent, or Firm*—Polster, Polster and Lucchesi

[57] ABSTRACT

A railroad car (R) for hauling trailers (T) has a hitch assembly (HA) for securing the trailer. The hitch assembly includes a retainer pin (P) extending through a head portion (H) of the hitch assembly. A retainer (1) for retaining the pin in place and for facilitating its removal and replacement includes a clip (3) attached to each side of the head adjacent the opening (O) in the side of the head adjacent the opening (O) in the side of the head through which the pin is installed or removed. Each clip projects outwardly from the respective side of the head and has an opening (9) corresponding to the opening in the side of the head. A fastener (11) is removably attachable to each clip through the opening in the clip. A portion (15) of the fastener abuts the outer end of the retainer pin when the fastener is assembled with the clip. This prevents longitudinal movement of the retainer pin.

4 Claims, 6 Drawing Figures

TRAILER HITCH RETAINER PIN RETENTION APPARATUS

BACKGROUND OF THE INVENTION

This invention relates to railway cars for transporting trailers and more particularly, to an improvement in hitch assemblies for such railroad cars in which removal and replacement of a retainer pin used with the assembly is facilitated.

Railroad cars for transporting trailers include a hitch assembly. The hitch assembly includes a head for capturing the king pin of the trailer being hauled. A portion of the head assembly includes a retainer pin which extends transversely of the car and head assembly. This pin may be removed and replaced during periodic maintenance on the railroad car. In the past, a plate has been welded to the side of the head assembly to cover the opening in the head assembly through which the retainer pin is installed. Consequently, removal and replacement of the pin requires the plates to be unwelded from the side of the head assembly. After a new retainer pin has been installed, a new plate is then placed over the openings on each side of the head and these plates are then welded to the head assembly. This is both a time consuming and expensive procedure, because of movement of the car to repair facilities for use of burning and welding equipment. What is required, is a structure which both facilitates removal and replacement of the retainer pin, without requiring a plate be welded and unwelded, and at the same time insures that the retainer pin, after installation, is not dislodged from the head assembly.

SUMMARY OF THE INVENTION

Among the several objects of the present invention may be noted an improvement for railroad cars for hauling trailers; the provision of such an improvement by which removal and replacement of a retainer pin in the head assembly on such cars is facilitated; and provision of such improvement by which the retainer pin is held in place during normal operation of the car; the provision of such improvement to greatly reduce the amount of time required to remove and replace a retainer pin thereby reducing maintenance and repair costs, to eliminate costs for switching railway car to and from a repair location for use of burning and welding equipment, and to preclude a time loss of use of revenue equipment; the provision of such an improvement which is fabricated from off-the-shelf items so to be lost cost, and require only hand tools for removal and reinstallation.

Briefly, the improvement of the present invention is directed to a railway car for hauling trailers. The car has a hitch assembly for securing the king pin of a trailer. The hitch assembly includes a pair of stanchions on opposite sides of the car and a head extending transversely of the longitudinal axis of the car and attached to the stanchions. A retainer pin extends through the head also transversely of the longitudinal axis of the car. The improvement comprises a retainer for maintaining the retainer pin in place in the head and for facilitating removal and replacement of the retainer pin during maintenance on the car. The retainer includes a clip attached to each side of the head adjacent an opening in the side of the head through which the retainer pin is installed and removed. Each clip projects outwardly from the respective side of the head and has an opening therein in registry with the opening in the side of the head. The opening in the clip is larger than the diameter of the retainer pin. A fastener is removably attachable to each clip through the opening in the clip. A portion of the fastener substantially abuts the outer end of the retainer clip. This prevents longitudinal movement of the retainer pin. The fastener is readily removable during maintenance of the car for ease of replacement of the retainer pin. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
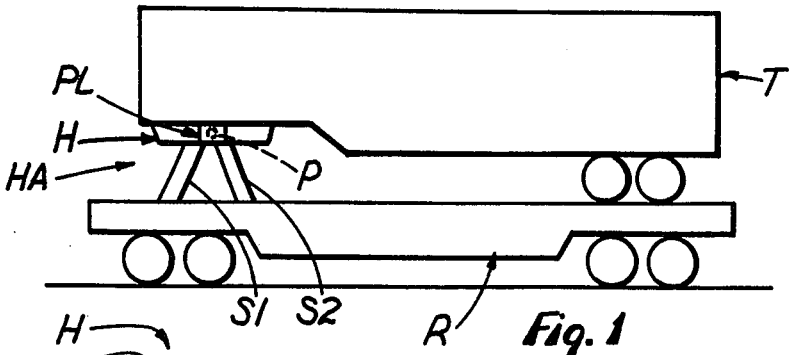
FIG. 1 is a side view of a railroad car for hauling a trailer.

Referring to the drawings, a railroad car R is shown in FIG. 1. Car R is of the type used to transport trailers such as the trailer T mounted on the bed of the car. Car R includes a hitch assembly HA for capturing and holding the hitch portion of trailer T for transportation of the trailer. Hitch assembly HA includes stanchions S1 and S2. A similar pair of stanchions is located on the opposite side of car R and a head H extends transversely of the longitudinal axis of the car and is attached to the stanchions on the respective opposite sides of the car. Head H has a top or horizontal plate portion HT (see FIGS. 2, 5 and 6) and respective vertical side members HS (also see FIGS. 2, 5 and 6). A retainer pin P extends transversely of the longitudinal axis of the car and is inserted in the head assembly through respective openings 0 in the side members of the head assembly.

Figure 2:
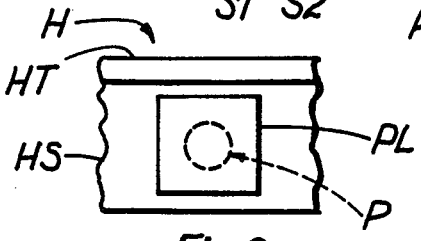
Fig. 2 Prior Art
FIG. 2 is a partial elevational view of the side of a head portion of a hitch assembly illustrating a prior art method of securing a retainer pin in the head.
Figure 3:
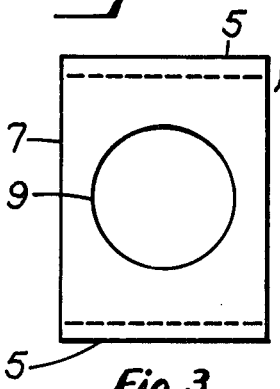
FIGS. 3 and 4 are top plan and side elevational views respectively of a clip which comprises a portion of the improvement of the present invention.
Figure 4:
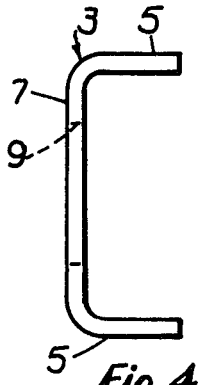

As shown in FIG. 2, the conventional method of retaining pin P in the head assembly is to weld a plate PL to the side member of the head assembly over the opening through which the retainer pin is inserted into the head assembly. This prevents the retainer pin from becoming dislodged during transportation of a trailer T on car R. During maintenance of car R, it is sometimes necessary to remove and replace the retainer pin. To do this, requires plate PL to be unwelded from the side member of the head assembly, the retainer pin removed, and a new retainer pin installed. After these steps are completed, the old plate PL or a new plate is then positioned as shown in FIG. 2 and welded in place. This has the disadvantage of making replacement of the retainer pin a time consuming and hence expensive operation.

Figure 6:
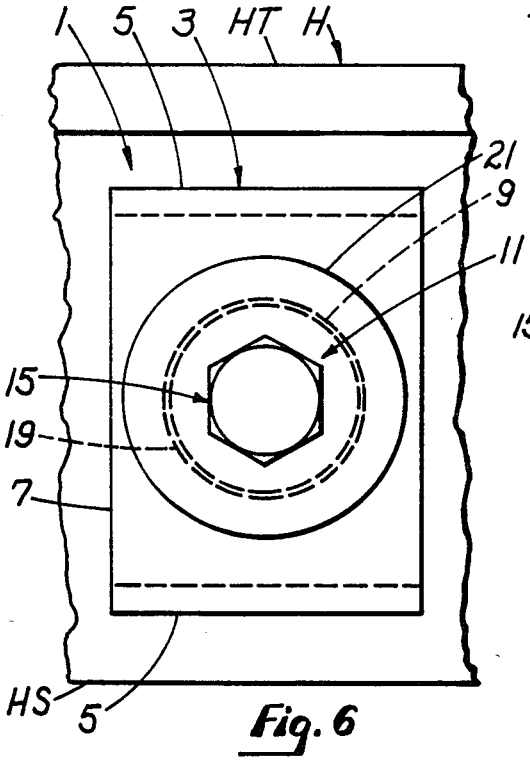
FIGS. 5 and 6 are side elevational and top plan views respectively of a retainer assembly comprising the improvement of the present invention.
Figure 5:
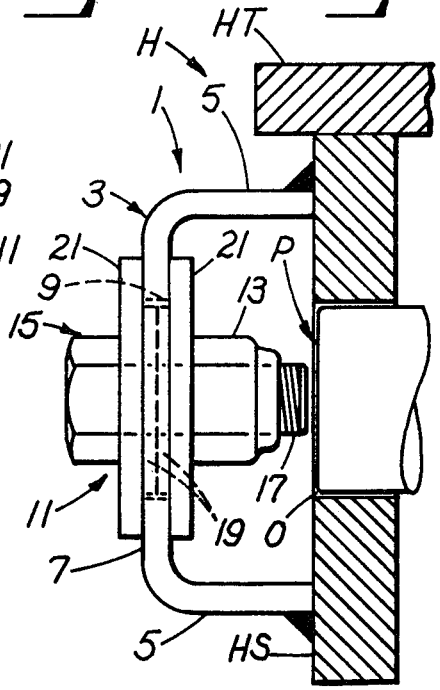

The improvement of the present invention comprises a retaining means indicated generally at 1 in FIGS. 5 and 6. Retaining means 1 is for maintaining retainer pin P in place in head H and is also for facilitating removal and replacement of the retainer pin during maintenance on car R. Means 1 includes a clip 3 which is attached to each side of head H adjacent the opening in the side of the head through which the retainer pin is installed and removed from the hitch assembly. Each clip 3 is a U-shaped retainer clip the legs 5 of which are attached to the respective sides HS of the head by welding. Consequently, each clip 3 projects outwardly from the respective side of head H. The base portion 7 of the retainer clip has a circular opening 9 formed therein. Clip 3 is attached to the side of head H such that opening 9 in the base of clip 3 is in registry with opening 0 and opening 9 is larger than the diameter of opening 0.

A fastening means is indicated generally at 11, and is removably attachable to each clip 3. Fastening means 11 includes a lock nut 13 and a bolt 15. As shown in FIG. 5, shank 17 of bolt 15 is sufficiently long so when fastening means 11 is assembled with clip 3, the inner end of the bolt is substantially abutting the outer end of retainer pin P. This prevents longitudinal movement of the retainer pin in the head assembly. The diameter of shank 17 is smaller than the diameter of opening 9 in the base of clip 3. To accommodate the bolt in the opening, fastening means 11 includes one or more washers 19 which are insertable into opening 9. The washers have a central opening (not shown) the diameter of which corresponds to the diameter of shank 17 of bolt 15. In addition, fastening means 11 includes an additional pair of washers 21 which are positioned on either side of opening 9 in clip 3.

It is a particular feature of the present invention that clip 3, lock nut 13, bolt 15, and washers 19 and 21 all be off-the-shelf items. This allows retaining means 1 to be of low cost. In addition, there is no longer the need to unweld a plate such as plate PL from the side of head H in order to remove a retainer pin P during service of car R. Rather, all that is now required, is for fastening means 11 to be removed from each clip 3, with retainer pin P then being extracted from the hitch assembly through the opening 9 in either clip 3. The replacement pin is then inserted into the hitch assembly through the opening in either clip. With the retainer pin again in place, fastening means 11 is then assembled with clip 3. When assembled as shown in FIG. 5, the substantially abutting relation between bolt 15 and retainer pin P prevents longitudinal or sliding movement of the retainer pin.

In view of the above, it will be seen that the several objects of the invention are achieved and other advantageous results obtained.

As various changes could be made in the above constructions without departing from the scope of the invention, it is intended that all matter contained in the above description and shown in the accompanying drawing shall be interpreted as illustrative and not in a limiting sense.

What is claimed is:

1. In a railroad car for hauling trailers, the car having a hitch assembly for securing the trailer, the hitch assembly including a pair of stanchions on opposite sides of the car and a head extending transversely of the longitudinal axis of the car and attached to the stanchiions, and a retainer pin extending through the head also transversely of the longitudinal axis of the car, the improvement comprising:

retaining means for maintaining the retainer pin in place in the head and for facilitating removal and replacement of the retainer pin during maintenance on the car, the retaining means including clip means attached to each side of the head adjacent an opening in the side of the head through which the retainer pin is installed and removed, each said clip means projecting outwardly from the respective side of the head and having an opening therein in registry with the opening in the side of the head and the diameter thereof, said clip means opening being so sized and positioned relative to the pin so as to permit removal of and installation of said pin from the head therethrough, and, fastening means removably attachable to each clip means through the opening in the clip means, a portion of the fastening means substantially abutting the outer end of the retainer pin when the fastening means is assembled with the clip means thereby preventing substantial longitudinal movement of the retainer pin, the fastening means being readily removable during maintenance on the car for ease of replacement of the retainer pin.

2. The improvement of claim 1 wherein each clip means comprises a U-shaped retainer clip the legs of which are attached to the respective sides of the head by welding or the like, and the base of the retainer clip has the opening therein.

3. The improvement of claim 2 wherein the fastening means includes a lock nut and a bolt, the bolt being sufficiently long so when assembled on the clip, the inner end of the bolt is immediately adjacent the respective outer end of the retainer pin.

4. The improvement of claim 3 wherein the diameter of the bolt is smaller than the diameter of the opening in the clip, and the retaining means further includes washer means insertable into the clip opening, the washer means having a central opening therein the diameter of which corresponds to the diameter of the bolt.

* * * * *